United States Patent [19]

Lambuth

[11] 4,413,459

[45] Nov. 8, 1983

[54] LAMINATED WOODEN STRUCTURAL ASSEMBLY

[75] Inventor: Alan L. Lambuth, Boise, Id.

[73] Assignee: Boise Cascade Corporation, Boise, Id.

[21] Appl. No.: 243,774

[22] Filed: Mar. 16, 1981

[51] Int. Cl.[3] ..... E04C 3/42; E04C 3/14

[52] U.S. Cl. ..... 52/729; 52/731

[58] Field of Search ..... 52/729, 690, 731

[56] References Cited

U.S. PATENT DOCUMENTS

| | | | |
|---|---|---|---|
| 1,358,080 | 11/1920 | Jones | 52/729 |
| 1,377,891 | 5/1921 | Knight | 52/729 |
| 2,230,628 | 2/1941 | Sahlberg | 52/729 |
| 3,490,188 | 1/1970 | Troutner | 52/729 |
| 3,960,637 | 1/1976 | Ostrow | 52/729 |
| 3,991,535 | 11/1976 | Keller et al. | 52/690 |
| 4,074,498 | 2/1978 | Keller et al. | 52/729 |
| 4,191,000 | 3/1980 | Henderson | 52/729 |
| 4,249,355 | 2/1981 | Anderson et al. | 52/729 |
| 4,336,678 | 6/1982 | Peters | 52/729 |

FOREIGN PATENT DOCUMENTS

| | | | |
|---|---|---|---|
| 691335 | 7/1964 | Canada | 52/729 |
| 624855 | 1/1936 | Fed. Rep. of Germany . | |
| 437720 | 11/1967 | Switzerland . | |
| 751882 | 7/1956 | United Kingdom | 52/729 |
| 978639 | 12/1964 | United Kingdom | 52/729 |

*Primary Examiner*—James L. Ridgill, Jr.

*Attorney, Agent, or Firm*—Laubscher, Philpitt & Laubscher

[57] ABSTRACT

A laminated wooden structural assembly is disclosed comprising at least one multi-ply wooden web member formed of a pair of spaced outer layers and at least one inner core layer bonded between the outer layers, and at least one wooden flange member arranged adjacent one longitudinal edge portion of the web member. The web and flange members are connected by joint means including a straight machine tapered longitudinal slot contained in one surface of the flange member, and a machine tapered longitudinal edge portion of the web member that is inserted with a friction fit into the slot. Each inner core layer of the web member is arranged with its grain direction extending toward the longitudinal edge portion of the web member, the outer layers being arranged with their grain directions extending parallel to the flange member. The flange member is arranged with its grain direction extending in a direction longitudinally and parallel with the grain direction of said web outer layers.

8 Claims, 5 Drawing Figures

LAMINATED WOODEN STRUCTURAL ASSEMBLY

BACKGROUND OF THE INVENTION

The subject invention relates generally to laminated wooden structural assemblies of the type including T-beams, I-beams, H-beams, box beams and the like. Previously these structural members have been produced from solid lumber components, but in recent years, owing to the diminishing supply of forest resources, wide dimension structural lumber has become rather expensive and difficult to produce from small diameter "sustained yield" trees.

As evidenced by the prior U.S. Pat. Nos. to Knight, 1,377,891, Sahlberg 2,230,628, and Troutner, 3,490,188, many kinds of reconstituted lumber products and composite trusses have been developed. These include short lengths of wide dimension lumber pieces connected by finger joints, short lengths of narrow dimension lumber finger-jointed to define long lengths which are then edge gluded to form the desired widths or are assembled in pairs with a metal-reinforced web between them (Trus Joist products), and long, wide dimension lumber made from thin wood veneers arranged and glued with all grains parallel (Microlam) with optional metal reinforcements. Based on combined material and labor costs, however, many of these structural composite elements are considerably more expensive than the solid lumber members they were designed to replace even though they do offer the advantage of conserving wood resources.

SUMMARY OF THE INVENTION

It is therefore a primary object of the present invention to provide a laminated wood structural assembly which overcomes the above disadvantages, and which provides a simple, inexpensive, and structurally strong design which has the further advantage of conserving wood resources.

It is another object of the present invention to provide a laminated wooden structural assembly comprising at least one multi-ply wooden web member having a pair of outer layers and at least one inner core layer bonded between the outer layers, and at least one wooden flange member extending adjacent one longitudinal edge portion of the web member, the longitudinal axis of the flange member being arranged parallel to one longitudinal edge portion of the web member. The web and flange members are connected by means of a strong, friction-fit adhesive joint.

It is a further object of the present invention to provide a laminated wooden structural assembly wherein the inner core layers of the web member are arranged with their grain directions extending toward the flange member while the outer layers of the web member are arranged with their grain directions extending parallel with the flange member. Further, the flange member is arranged with its grain direction extending longitudinally and parallel with the grain direction of the outer layers of the web member.

A more specific object of the present invention is to provide a laminated wooden structural assembly having thickness dimensions in accordance with the following expression:

$$\frac{t_i}{w_f} > \frac{FS}{CS}$$

where:

$t_i$=total thickness of the inner core layers;

$w_f$=width of the flange member;

FS=fiber stress at the proportional limit, per unit area, in a compressive direction perpendicular to the grain of said flange member; and CS=maximum crushing strength, per unit area, in a compressive direction parallel to the grain of said inner core layers.

BRIEF DESCRIPTION OF THE DRAWING

Additional objects and advantages of the present invention will be understood from the following detailed description and the accompanying drawing, wherein.

DETAILED DESCRIPTION OF THE INVENTION

The laminated wooden structural assembly of the present invention has one of a number of configuration, including T-beams, I-beams, box beams and the like. The structural assembly includes at least one multi-ply wooden web member having a pair of spaced outer layers between which is bonded at least one inner core layer, and at least one wooden flange member extending adjacent one longitudinal edge portion of the web member.

Figure 1:
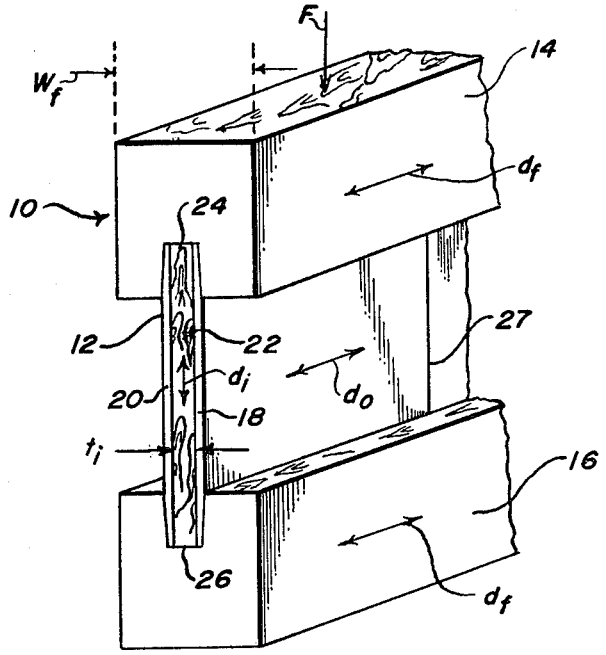
FIG. 1 is a front perspective view of a portion of one I-beam embodiment in accordance with the present invention.

Referring first to FIG. 1, the laminated wooden structural assembly of the present invention is in the form of an I-beam 10 including a vertical web member 12 and upper and lower horizontal flange members 14 and 16, respectively. The web member 12 includes a pair of spaced outer layers 18 and 20 between which is bonded an inner core layer 22. Flange members 14 and 16 extend parallel to and adjacent the upper and lower longitudinal edge portions 24 and 26, respectively, of web member 12 and are rigidly connected therewith by means of a friction fit adhesive joint which will be described in detail below.

Web member 12 may comprise a plurality of aligned multi-ply web sections which are arranged end to end with joint means connecting together the adjacent ends of successive web sections. The joint means may be a simple butt joint 27 as shown in FIG. 1, or, for example in a T-beam, a spline, scarf or finger type joint may be utilized.

Inner core layer 22 is arranged with its grain direction, $d_i$, extending toward flange members 14 and 16 and normal to said longitudinal edge portions 24 and 26, and outer layers 18 and 20 are arranged with their grain directions, $d_o$, extending parallel to said longitudinal edge portions 24 and 26 and flange members 14 and 16. Furthermore, flange members 14 and 16 are arranged with their grain directions, $d_f$, extending parallel with the grain directions, $d_o$, of the outer layers 18 and 20.

With the application of a load bearing force F to the I-beam of FIG. 1, a compressive fiber stress is applied to flange member 14 in a direction perpendicular to its grain direction $d_f$. However, the same load bearing force F applies a compressive crushing force to inner core layer 22 in a direction parallel to is grain direction $d_i$.

Generally, the maximum compressive crushing strength in a direction parallel to the grain direction of a particular species of wood, per unit area, is from 8 to 10 times greater than the compressive fiber stress at the proportional limit in a direction perpendicular to the grain direction of the species of wood, per unit area. Table 1 discloses these compressive strength properties for various species of wood.

Viewing the physical properties disclosed in Table 1, the thickness dimensions of the laminated wooden structural assembly of the present invention may be determined to provide an assembly of maximum strength while utilizing a minimum of wood resources. Referring again to the I-beam of FIG. 1, when the web and flange members are formed from the same wood species, the web member will withstand 8 to 10 times the compressive load F per unit area than the flange member is able to withstand without failure. Expressed in design parameter terms, the thickness, $t_i$, of inner core layer 22 therefore need only be from one eighth to one tenth the width, $w_f$, of the flange member 14 in order to support all the compressive load which the flange member can adequately carry.

To ensure that the inner core layers are of sufficient thickness to support any compressive load which the flange member can adequately carry, the following expression must be satisfied:

$$\frac{t_i}{w_f} > \frac{FS}{CS} \qquad \text{Equation (1)}$$

where:

TABLE 1

Mechanical properties* of some commercially important woods grown in the United States.

| Common Names of Species | Specific Gravity | Compression parallel to grain-maximum crushing strength | Compression perpendicular to grain-fiber stress at proportional limit |
|---|---|---|---|
| Hardwoods: | | | |
| Aspen, Bigtooth | .36 | 2500 | 210 |
| | .39 | 5300 | 450 |
| Birch, Yellow | .55 | 3380 | 430 |
| | .62 | 8170 | 970 |
| Elm, American | .46 | 2910 | 360 |
| | .50 | 5520 | 690 |
| Maple, Bigleaf | .44 | 3240 | 450 |
| | .48 | 5950 | 750 |
| Oak, Southern Red | .52 | 3030 | 550 |
| | .59 | 6090 | 870 |
| Oak, Chestnut | .57 | 3520 | 530 |
| (White) | .66 | 6830 | 840 |
| Yellow-poplar | .40 | 2660 | 270 |
| | .42 | 5540 | 500 |
| Softwoods: | | | |
| Cedar, Western Red | .31 | 2770 | 240 |

TABLE 1-continued

Mechanical properties* of some commercially important woods grown in the United States.

| Common Names of Species | Specific Gravity | Compression parallel to grain-maximum crushing strength | Compression perpendicular to grain-fiber stress at proportional limit |
|---|---|---|---|
| | .32 | 4560 | 460 |
| Douglas-fir, Coast | .45 | 3780 | 380 |
| | .48 | 7240 | 800 |
| Fir, White | .37 | 2900 | 280 |
| | .39 | 5810 | 530 |
| Hemlock, Western | .42 | 3360 | 280 |
| | .45 | 7110 | 550 |
| Larch, Western | .48 | 3760 | 400 |
| | .52 | 7640 | 930 |
| Pine, Ponderosa | .38 | 2450 | 280 |
| | .40 | 5320 | 580 |
| Pine, Longleaf | .54 | 4320 | 480 |
| (Southern) | .59 | 8470 | 960 |
| Spruce, White | .37 | 2570 | 240 |
| | .40 | 5470 | 460 |

*Results of tests on small, clear straight-grained specimens. (Values in the first line for each species are from tests of green material; those in the second line are adjusted to 12 percent moisture content.) Specific gravity is based on weight when ovendry and volume when green or at 12 percent moisture content.

$t_i$ = total thickness of said inner core layers;

$w_f$ = width of said flange member;

FS = fiber stress at the proportional limit, per unit area, in a compressive direction perpendicular to the grain of said flange member; and CS = maximum crushing strength, per unit area, in a compressive direction parallel to the grain of said inner core layer.

The web and flange members may be of varying wood species as long as Equation (1) is satisfied by the dimensions and physical properties of the structural assembly. In the I-beam of FIG. 1, a very strong wood, such as Western Larch or Longleaf Pine can be used as an inner core layer 22 while flange 14 is a lower density commercial lumber specie such as white spruce. From Table 1 and Equation 1, it is apparent that for a flange width, $w_f$, of 1.5 inches, the inner core thickness, $t_i$, may be as small as 0.10 inches (using FS and CS values at 12 percent moisture content).

Among the soft and hard wood species commonly used as veneer layers, the "compression parallel to grain" property (Table I) varies generally from a low of 2500 p.s.i. to a high of 8000 p.s.i. or more, and veneer layers are generally available in thicknesses of 1/10, ⅛, 1/7, 1/6, 5/32, 3/16, 1/5, 7/32 and ¼ inch. By using these two property ranges, a number of web and flange combinations may be produced in proper structural balance by appropriate combinations of specie strength and relative thicknesses in accordance with Equation (1).

The structural assembly of the present invention includes means for rigidly connecting the web and flange members, which connecting means includes a longitudinal slot contained in the surface of the flange member opposite one longitudinal edge portion of the web member, into which slot said longitudinal edge portion of the web member is inserted to form a friction fit joint. The longitudinal slot contained in the flange member is of a sufficient depth to provide a sufficiently strong joint, but preferably the slot should be of a depth of at least three eighths of an inch.

Figure 2:
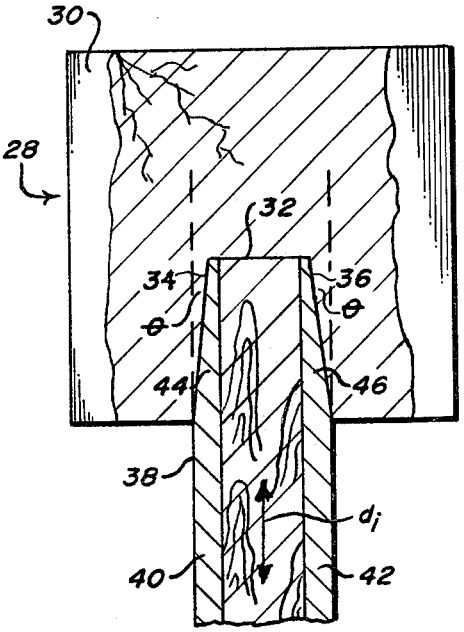
FIG. 2 is a detailed cross sectional view of a portion of one T-beam embodiment in accordance with the present invention.

More particularly, in the cross-sectional view of the T-beam 28 of FIG. 2, flange member 30 contains a longitudinal slot having a center edge portion 32 and side edge portions 34 and 36. Web member 38 is inserted within the slot to form a friction fit joint. Suitable adhesive, such as a phenol resorcinol-formaldehyde lumber laminating glue, is applied to all mating surfaces of the web or flange members prior to assembly to provide the joint with additional strength.

In accordance with the structural assembly of the present invention, outer layers 40 and 42 of web member 38 have grain directions extending parallel to the grain directions of flange member 30, while the inner core layer of the web member has its grain direction $d_i$ extending vertically and perpendicular to that of the flange member 30, as shown in FIG. 2. This orientation of parallel grain directions provides a joint strength sufficient to withstand the forces which the web and flange members can support. The parallel grain joints are substantially stronger than the cross-lap joint commonly employed in composite members where the grain directions of the mating surfaces are at right angles to one another. The parallel grain joints resist even slight lateral displacement along the web-flange joint under bending load better than other assembly configurations, thereby imparting significantly greater stiffness and strength.

To provide an even stronger and more rigid joint between the web and flange members, the longitudinal edge portions 44 and 46 of outer layers 40 and 42, respectively, in contact with longitudinal slot flag side edges 34 and 36, are tapered inwardly by the angle $\theta$. Similarly, the portion of longitudinal slot side edges 34 and 36 in contact with outer layer edge portions 44 and 46 are tapered an amount substantially corresponding to the angle by which the flat outer layer edge portions 44 and 46 are tapered. The tapered angle $\theta$ ranges in span from 1 to 10 degrees, which tapering is achieved by machining. It is important to note that the machine tapering of the outer layer edge portions 44 and 46 and slot side edges 34 and 36 places the parallel fibers of the outer layers and flange members in intimate contact, thereby strengthening the parallel-grain joint. The tapered surfaces are machined rather than crushed to avoid loosening of the edge fibers from one another which loosening prevents the formation of an integral and rigid wood surface for bonding. Such loosening results from a tapered surface formed by a crushing operation.

Figure 3:
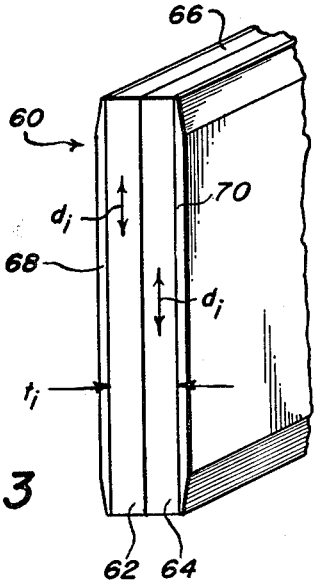
FIG. 3 is a front perspective view of a portion of one web member embodiment of the present invention.

Another embodiment of a multi-ply web member of the present invention is shown in FIG. 3, wherein the web member 60 includes two inner core members 62 and 64 arranged with their grain directions $d_i$, extending in a direction normal to longitudinal edge portion 66. Outer layers 68 and 70 are arranged with their grain directions extending in a direction, $d_o$, parallel with longitudinal edge portion 66. The sum of the combined thicknesses of inner cores 62 and 64 is equal to the value of $t_i$ used in Equation 1. The multi-ply web member of the present invention may include as many inner core layers as is necessary to achieve a thickness, $t_i$, in accordance with Equation (1).

Figure 4:
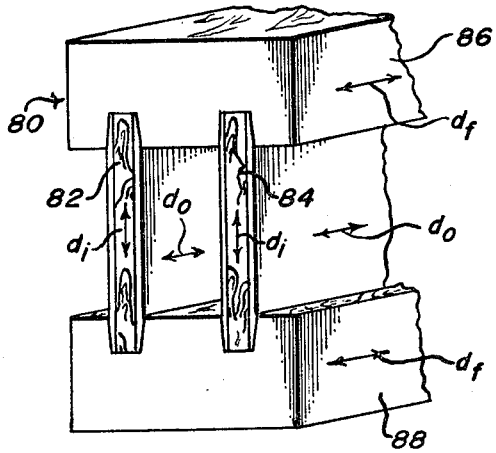
FIG. 4 is a front perspective view of a portion of one box-beam embodiment in accordance with the present invention.

Another embodiment of the structural assembly of the present invention is the box-beam 80 of FIG. 4, wherein the structural member 80 includes two spaced vertical parallel web members 82 and 84 arranged between two horizontal upper and lower flange members 86 and 88, respectively. Flange members 86 and 88 are connected with the upper and lower longitudinal edge portions, respectively, of web members 82 and 84 by means of the tapered friction fit joint of the present invention.

The flange members of the present invention comprise either solid lumber of multi-ply veneer members having all veneer layer grain directions extending parallel with one another, as in Microlam flanges.

Figure 5:
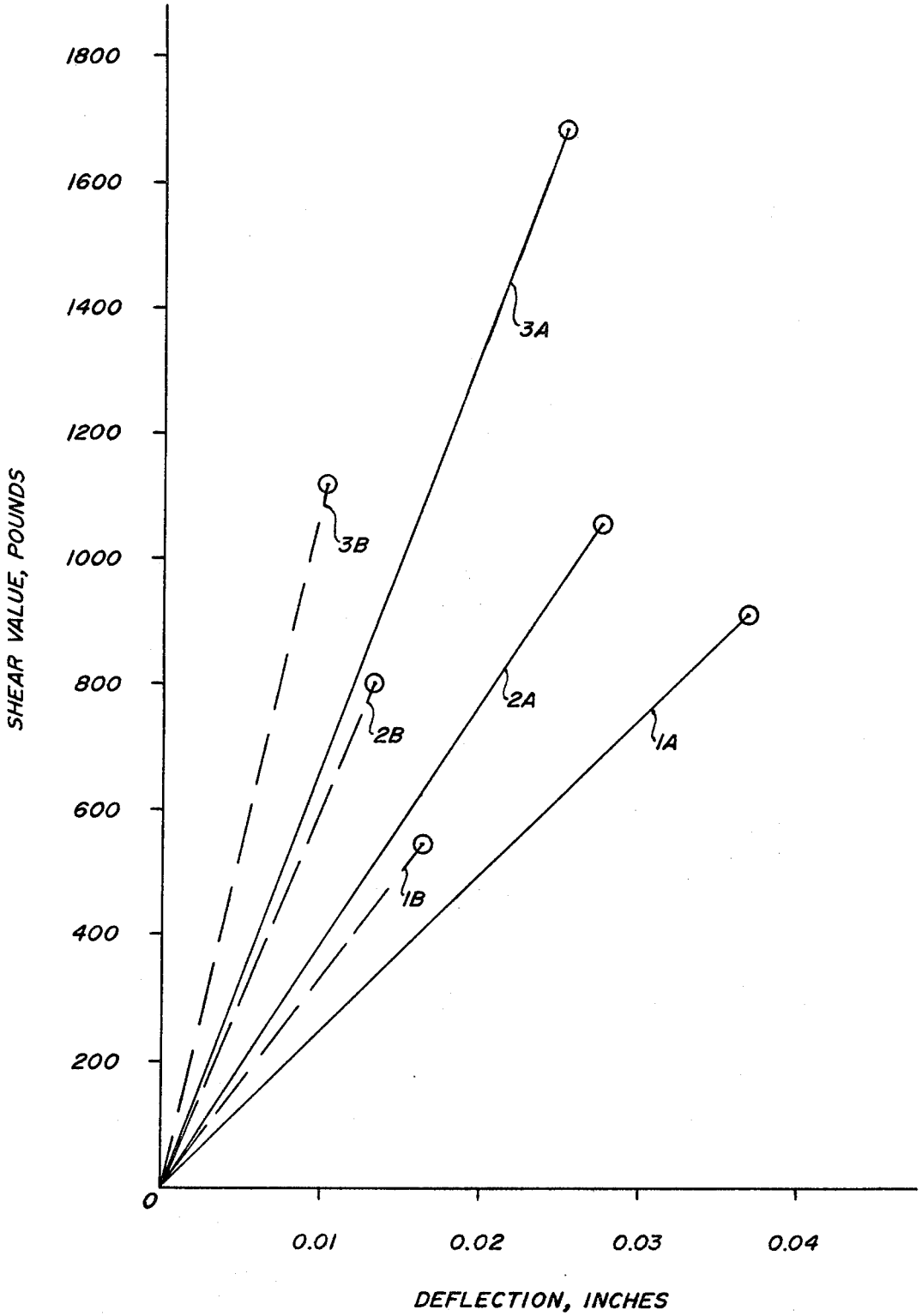
FIG. 5 is a graph disclosing strength test results of the structural member of the present invention compared with structural members of the prior art.

FIG. 5 discloses the results of compressive testing of structural assemblies of the present invention compared with structural assemblies of the prior art. Specifically, the curves represent the deflection along the glue joint of various I-beams in response to shear loads applied parallel to the joint between the web and flange members. Curves 1A and 1B represent deflection towards the maximum shear and towards the proportional limit stress, respectively, for a 'TJI' Trus Joist I-beam with outer layers of the web member arranged so that their grain directions extend toward the flange member and normal to the grain direction of the flange member. The 'TJI' beam joint includes web and slot longitudinal edge and side portions, respectively, which are crushed to 5 degree matching tapers. Curves 2A and 2B represent deflection towards the maximum shear and towards the proportional limit stress, respectively, for an I-beam having outer veneer layers of the web member arranged so that their grain directions extend toward the flange member and normal to the grain direction of the flange member. This I-beam joint includes web and slot longitudinal edge and side portions, respectively, which are machined to 5 degree matching tapers. Curves 3A and 3B represent deflection towards the maximum shear and towards the proportional limit stress, respectively, for an I-beam having outer core layers arranged with their grain directions extending parallel with the flange member and parallel with the grain direction of the flange member. This I-beam joint includes web and slot longitudinal edge and side portions, respectively, which are machined to 5 degree matching tapers. The flanges of all three types of I-beams tested comprised Microlam laminated veneer wood, thereby avoiding variations in structural assembly strengths due to variations in flange material.

The strongest and least yielding assembly is represented by curves 3A and 3B, that is, the assembly having outer layer grain directions extending parallel to the grain direction of the flange member with web edge and slot side portions machine tapered. In this beam, there was no influence of rolling shear among the lathe checks in the vertically disposed web face veneers, nor was there influence of loosened wood fibers due to edge crushing. All wood fibers on both sides of the web-flange joint were undisturbed and were pulling parallel to one another as the joint was stressed in shear.

It is to be understood that the embodiments of the present invention herein disclosed and described are illustrative examples of the same and do not limit the scope of the invention.

What is claimed is:

1. A laminated wooden structural assembly, comprising (a) at least one multi-ply generally rectangular web member including a pair of spaced parallel outer layers, and at least one inner core layer bonded between said outer layers, each of said layers being formed of wood;

(b) at least one wooden flange member arranged adjacent one longitudinal edge portion of said web member, the longitudinal axis of said flange member being parallel with said one longitudinal edge portion of said web member; and (c) means rigidly connecting said web and flange members, said connecting means including
  (1) a longitudinal slot contained in the surface of said flange member adjacent said web member;
  (2) the longitudinal edge portion of said web member being inserted with a friction fit within said longitudinal slot; and
  (3) adhesive means bonding together the mating surfaces of said longitudinal edge portion and said slot;

(d) the inner core and outer layers of said web member being arranged with their grain directions ($d_i$, $d_o$) extending toward and parallel with said flange member, respectively;

(e) said flange member being arranged with its grain direction ($d_f$) extending longitudinally and parallel with the grain direction of said web outer layers;

(f) the thickness dimensions of said inner core layer and said flange member being in accordance with the expression:

$$\frac{t_i}{w_f} > \frac{FS}{CS}$$

where:

$t_i$=total thickness of said inner core layers;

$w_f$=width of said flange member;

FS=fiber stress at the proportional limit, per unit area, in a compressive direction perpendicular to the grain of said flange member; and CS=maximum crushing strength, per unit area, in a compressive direction parallel to the grain of said inner core layer.

2. A laminated wooden structural assembly, comprising (a) at least one multi-ply generally rectangular web member including a pair of spaced parallel outer layers, and at least one inner core layer bonded between said outer layers, each of said layers being formed of wood;

(b) at least one wooden flange member arranged adjacent one longitudinal edge portion of said web member, the longitudinal axis of said flange member being parallel with said one longitudinal edge portion of said web member; and (c) means rigidly connecting said web and flange members, said connecting means including
  (1) a longitudinal slot contained in the surface of said flange member adjacent said web member;
  (2) the longitudinal edge portion of said web member being inserted with a friction fit within said longitudinal slot; and
  (3) adhesive means bonding together the mating surfaces of said longitudinal edge portion and said slot;

(d) the inner core and outer layers of said web member being arranged with their grain directions ($d_i$, $d_o$) extending toward and parallel with said flange member, respectively;

(e) said flange member being arranged with its grain direction ($d_f$) extending longitudinally and parallel with the grain direction of said web outer layers.

3. A laminated wooden structural assembly as defined in claim 2, wherein the side walls of the slot and the corresponding wall portions are machine-tapered inwardly.

4. A laminated wooden assembly as defined in claim 3, wherein the side walls of the slot and the corresponding wall portions of the web are machine-tapered inwardly with a matching angle of from 1 to 10 degress in the depth directions of the slot.

5. A laminated wooden assembly as defined in claim 2, and further including a second web member arranged between said flange members in spaced parallel relation relative to said web member, each of the longitudinal edge portions of said second web member being connected with said flange members by means of a friction-fit adhesive joint.

6. A laminated wooden assembly as defined in claim 4, wherein said multi-ply web member includes at least two inner core layers arranged with their grain directions ($d_i$) extending normal to said web member longitudinal edge portion.

7. A laminated wooden assembly as defined in claim 4, and further including a second flange member adjacent the other longitudinal edge portion of said web member joint, and friction-fit adhesive joint means connecting said second flange member with said web member, thereby forming a structural member having an I-shaped cross-sectional configuration.

8. A laminated wooden assembly as defined in claim 3, wherein said web member comprises a plurality of aligned multi-ply web sections arranged end-to-end, and joint means connecting together the adjacent ends of successive sections.

* * * * *

UNITED STATES PATENT AND TRADEMARK OFFICE

CERTIFICATE OF CORRECTION

PATENT NO. : 4,413,459

DATED : November 8, 1983

INVENTOR(S) : Alan L. Lambuth

It is certified that error appears in the above-identified patent and that said Letters Patent is hereby corrected as shown below:

Claim 5, line 2, change "2" to -- 7 --.

Claim 8, line 2, change "3" to -- 7 --.

Signed and Sealed this

*Seventh* Day of *August 1984*

[SEAL]

*Attest:*

GERALD J. MOSSINGHOFF

*Attesting Officer*

*Commissioner of Patents and Trademarks*